US005687935A

United States Patent [19]

Durchschlag et al.

[11] Patent Number: 5,687,935

[45] Date of Patent: Nov. 18, 1997

[54] DEVICE FOR OPERATING SWITCHES

[75] Inventors: Gerald Durchschlag, Zeltweg; Herbert Achleitner, Graz, both of Austria

[73] Assignee: VAE Aktiengesellschaft, Vienna, Austria

[21] Appl. No.: 601,035

[22] PCT Filed: Jun. 21, 1995

[86] PCT No.: PCT/AT95/00125

§ 371 Date: Feb. 23, 1996

§ 102(e) Date: Feb. 23, 1996

[87] PCT Pub. No.: WO96/00160

PCT Pub. Date: Jan. 4, 1996

[30] Foreign Application Priority Data

Jun. 24, 1994 [AT] Austria ..... 140/94
May 3, 1995 [AT] Austria ..... 758/95

[51] Int. Cl.[6] ..... B61L 5/00

[52] U.S. Cl. ..... 246/257; 246/262

[58] Field of Search ..... 246/257, 258, 246/449, 452, 430, 262

[56] References Cited

U.S. PATENT DOCUMENTS

| | | | |
|---|---|---|---|
| 2,367,716 | 1/1945 | Cobourn | 246/258 |
| 3,745,336 | 7/1973 | Dohse et al. . | |
| 4,213,588 | 7/1980 | Bowles | 246/258 |
| 5,292,091 | 3/1994 | Callegari et al. . | |

FOREIGN PATENT DOCUMENTS

| | | | |
|---|---|---|---|
| 586627 | 9/1924 | France | 246/258 |
| 2 196 619 | 3/1974 | France . | |
| 2 280 537 | 2/1976 | France . | |
| 1005112 | 1/1955 | Germany | 246/257 |
| 1105450 | 4/1961 | Germany | 246/258 |
| 2 144 564 | 3/1973 | Germany . | |
| 28 17 782 | 10/1979 | Germany . | |

*Primary Examiner*—Mark T. Le
*Attorney, Agent, or Firm*—Cushman Darby & Cushman, IP Group of Pillsbury Madison & Sutro LLP

[57] ABSTRACT

A device for operating switches includes a plurality of interlinked hydraulic switching devices (7) offset in the longitudinal direction of the rails. The first mechanical switching device is connected with a hydraulic cylinder/piston unit acting as a pumping element, the working volumes (13) of this first hydraulic cylinder/piston unit (7) acting as a pumping element being connected with the working volumes (13) of consecutive hydraulic cylinder/piston units (7) so as to be driven in same direction.

9 Claims, 9 Drawing Sheets

DEVICE FOR OPERATING SWITCHES

This application claims benefit of International application PCT/AT95/00125, filed Jun. 21, 1995.

BACKGROUND OF THE INVENTION

1. Field of the Invention

The invention relates to a device for operating switches, in which a plurality of interlinked hydraulic switching devices are arranged to be offset in the longitudinal direction of the rails. In such devices for operating switches it is known to realize the connection of the individual locks by means of a mechanical rod assembly. However, such a mechanical connection of a plurality of switching devices or locks requires relatively much space as well as a great number of different individual components. In addition to requiring more space, such a mechanical connection impedes the ability of the tongue means to be packed and, moreover, causes an unfavorable unilateral mass distribution on a switch.

2. Prior Art

From EP-A2 480 303 a hydraulic switching device has already been known, in which a plurality of individual actuating cylinders are controlled from a hydraulic station. From DE-B2 19 52 823 different circuit arrangements for the series or parallel connection of a plurality of such hydraulic switching devices have been known.

The known hydraulic switching devices each require a separate hydraulic drive unit, thus calling for a relatively expensive overall structure.

SUMMARY OF THE INVENTION

The invention aims at providing a device of the initially defined kind, which can be installed in existing switch operating arrangements in a simple manner by way of addition and which does not involve any expenditures for an additional drive unit and an accordingly expensive control unit. In particular, the invention aims at safeguarding a high degree of reliability and non-susceptibility to failures despite a simple mode of construction requiring only few different structural components. Finally, the device according to the invention is to be applicable in a simple manner as a substitute for mechanical devices of known construction to enhance the packability of the tongue means and to avoid unilateral mass distribution on a switch.

To solve this object, the object according to the invention essentially consists in that at least one hydraulic cylinder/piston unit is connected with a first mechanical switching device, the cylinder volumes of which cylinder/piston unit (s), as pump working volumes, are connected with the working volumes of neighboring switching devices comprised of hydraulic cylinder/piston units so as to be driven in same direction. By the fact that a first cylinder/piston unit is employed as a pumping element, expensive drive units may be obviated. In a switching procedure, the pump unit displaces fluid from the respective working volume into working volumes of identically configured cylinder/piston units, thus being able to immediately realize coupling with neighboring cylinder/piston units. On the whole, such a device may be assembled of identically designed cylinder/piston units of particularly simple modes of construction with nothing but appropriate hydraulic ducts having to be provided for the interconnection of neighboring cylinder/piston units. Interconnection each is effected in a manner that the equidirectional displacement of neighboring cylinder/piston units will be caused if medium is pressed out of the first passive cylinder/piston unit actuated by the mechanical switching device.

In a particularly simple manner, the configuration according to the invention is further developed in a manner that the pumping element and the hydraulic switching devices each contain in a cylinder a floating piston or a plunger, respectively, that is guided between two working volumes, the end or annular surfaces of the piston or plunger each plunging into the respective opposite working volumes having identical cross sectional areas. Such a floating piston or plunger constitutes a structurally particularly simple, operationally safe and compact structural unit to be arranged on the respectively desired site while requiring little space. There may be provided a plurality of identical cylinder/piston units of this type, the essential advantage being that identical cross sectional areas are each actuated by means of a pressure medium such that synchronous movement is obtained.

If non-linear displacement is desired, the respective cross sectional correction may be effected with such a configuration in a simple manner by means of sealing elements or packings in order to ensure the respectively sought course of displacement with the respectively displaced volume remaining constant. Thus, a hydraulic switching device of this kind including floating pistons or plungers, in addition to its compact mode of construction, also offers a simple way of adaptation to the requirements desired in each case.

For coupling the hydraulic switching devices and the pumping cylinder, respectively, with the mechanical switching devices, the configuration advantageously may be devised such that the piston or plunger of the pumping element comprises a bearing, in particular a sliding block having an annular grove or a bearing eye between its free ends, and that the bearing is arranged to project from an opening of the cylinder or between two stationarily fixed cylinders. A particularly simple and operationally safe compact design is again feasible, which is suitable also for subsequent installation in a simple manner.

Instead of the initially mentioned plungers or floating pistons, the respective annular surface of a piston may ensure the required identical working cross sections in both directions of displacement, as already pointed out above. A particularly simple construction in this case is provided in that the piston is rigidly connected with a continuous piston rod sealingly passing through the cylinders and that the piston rod or the cylinder is stationarily fixed.

In order to guarantee a high degree of safety, the overall system advantageously is adjusted at a predetermined overpressure relative to atmospheric pressure. In this manner, temperature fluctuations, which might lead to changes in pressure, can be buffered, to which end the configuration advantageously is devised such that the working volumes of the cylinder/piston units are connected with a pressure reservoir via overpressure valves. In a particularly simple manner, said overpressure valves are designed as nonreturn valves that may be triggered open, such controllable nonreturn valves implying a high degree of operating safety. At high operating temperatures medium is pressed out into the pressure reservoir by triggering the nonreturn valves open, whereas, with the pressure decreasing, the pressure must be made reavailable to the system via the nonreturn valves. In order to ensure, with such a configuration, that the operating safety continues to be safeguarded in case of a leakage occurring within the duct system by warning in time, the configuration in a particularly simple manner may be devised such that a pressure-controlled directional control valve is each connected to the pump working volumes, which gets into the closed position as the pressure falls below a predetermined pressure, thus ensuring that all of the switching devices are blocked in that case. Blocking of the switching devices would be signalized by the mechanical actuating drive and the pertaining control means for the mechanical actuating drive on the respective site such that the repair of any defect may be initiated at once.

An alternative method to cross-section changing, for controlling a switching position differing along the rail track is provided by a configuration which preferably is devised such that push-open valves are arranged in a duct connecting the two working volumes of a cylinder/piston unit and designed, for instance, as a bore. This connection is interrupted as a function of the position of the piston or plunger, or there is a flow-through with the set position being exactly assumable.

BRIEF DESCRIPTION OF THE DRAWINGS

In the following, the invention will be explained in more detail by way of exemplary embodiments schematically illustrated in the drawing. Therein.

DETAILED DESCRIPTION OF PREFERRED EMBODIMENTS OF THE INVENTION

Figure 1:
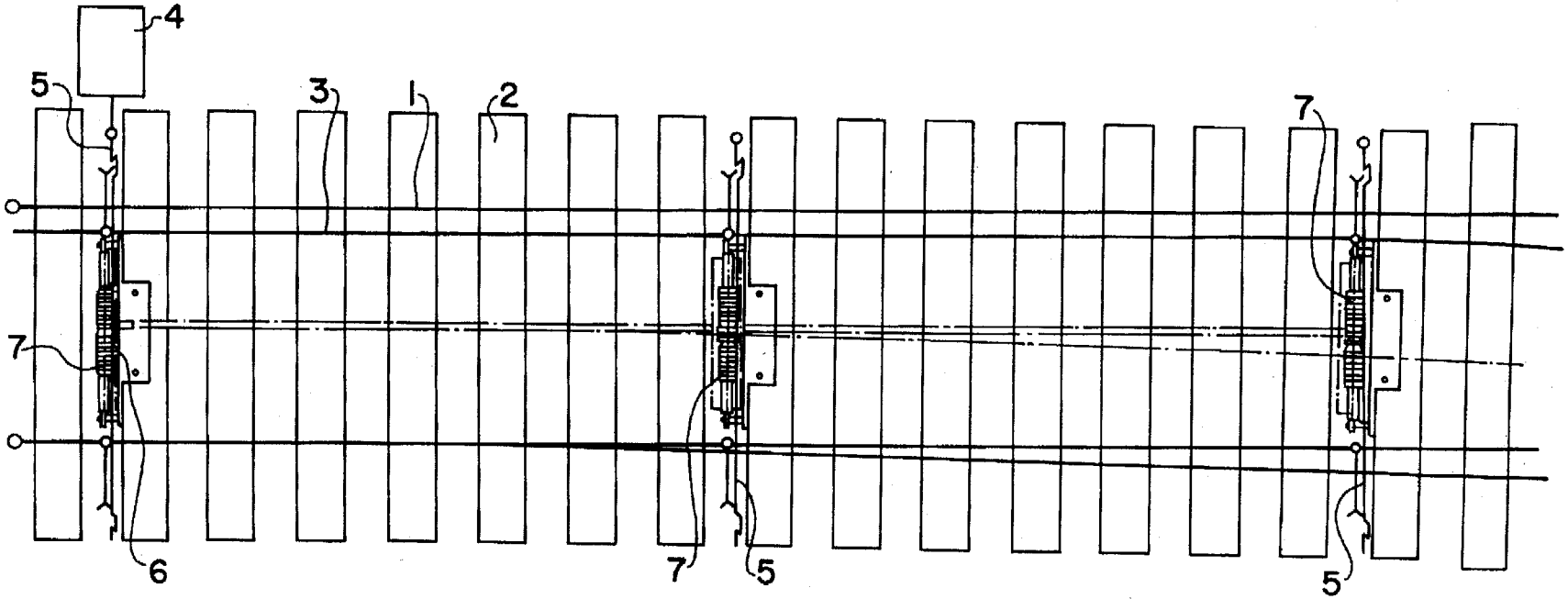
FIG. 1 is a top view on a section of a rail switch.
Figure 2:
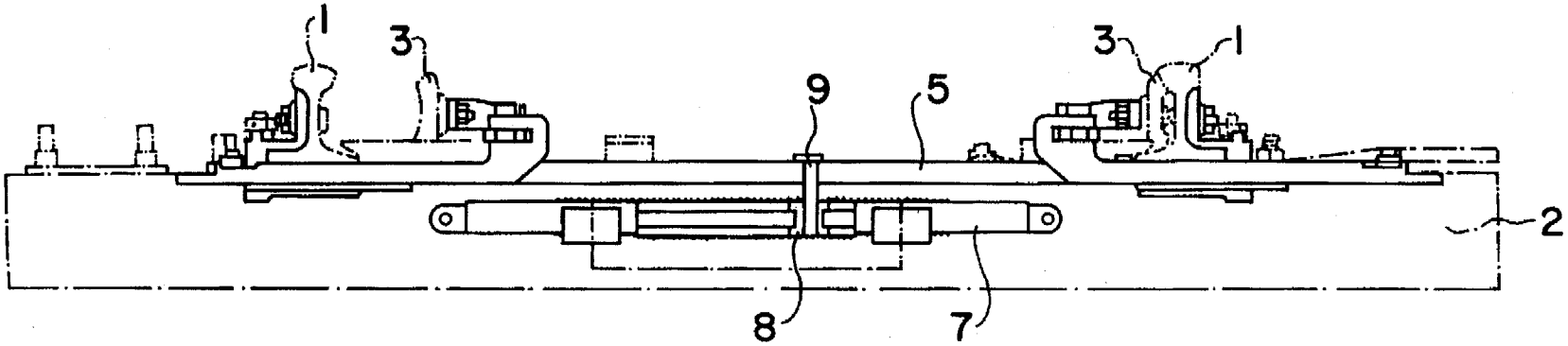
FIG. 2 shows a detail of the connection of a cylinder/piston unit including a mechanical slide rod.
Figure 3:
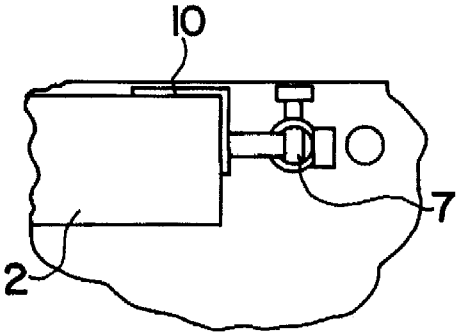
FIG. 3 is a schematic partial view of the illustration according to FIG. 2.

FIG. 1 schematically indicates rails 1, which are connected with sleepers 2. In the region of a switch, tongue rails 3 are provided in addition to the standard rails 1, which tongue rails may be brought into the respective position by means of an actuator schematically indicated by 4. The actuator 4 acts on the tongue rails 3 via slide rods 5. The slide rods 5 are coupled with a hydraulic cylinder/piston unit 7 via a central tap 6. Furthermore, additional hydraulic cylinder/piston units 7 are visible in the rail track, each being coupled with slide rods and locking devices, which are again schematically indicated by 5. From the representation of FIG. 2 the type of the mechanical connection of the hydraulic cylinder/piston units 7 by the slide rods 5 is more clearly apparent. The cylinder/piston units 7 each comprise a sliding block 8 in which a pin 9 of the slide rod 5 is engaged. Upon actuation of the slide rod 5, the sliding blocks and hence the pistons of the hydraulic cylinder/piston units are displaced, thus pressing medium out of the respective working volume. FIG. 3 clearly shows the type of fixation of the hydraulic cylinder/piston unit 7 to the sleeper 2. Fixation is realized by means of a stop plate 10 fixed to the sleeper 2. The hydraulic cylinder/piston units 7 thereby require relatively little space such that the packing of the substructure will not be affected.

Figure 4:
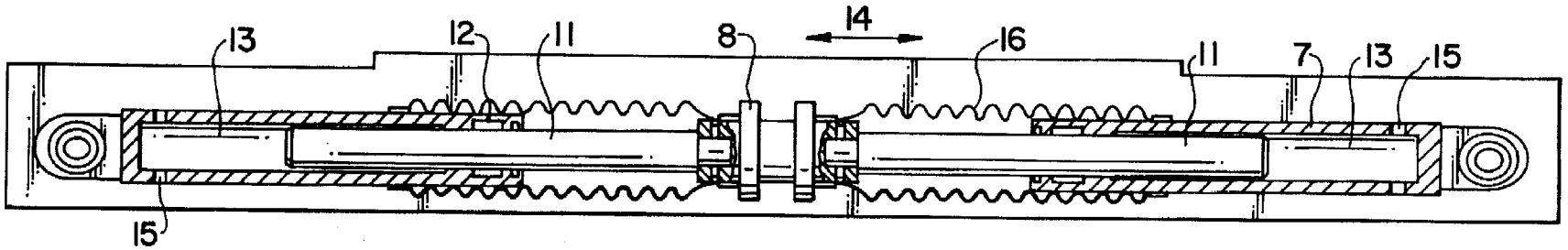
FIG. 4 is a partially sectioned illustration of the hydraulic cylinder/piston unit on an enlarged scale.
Figure 5:
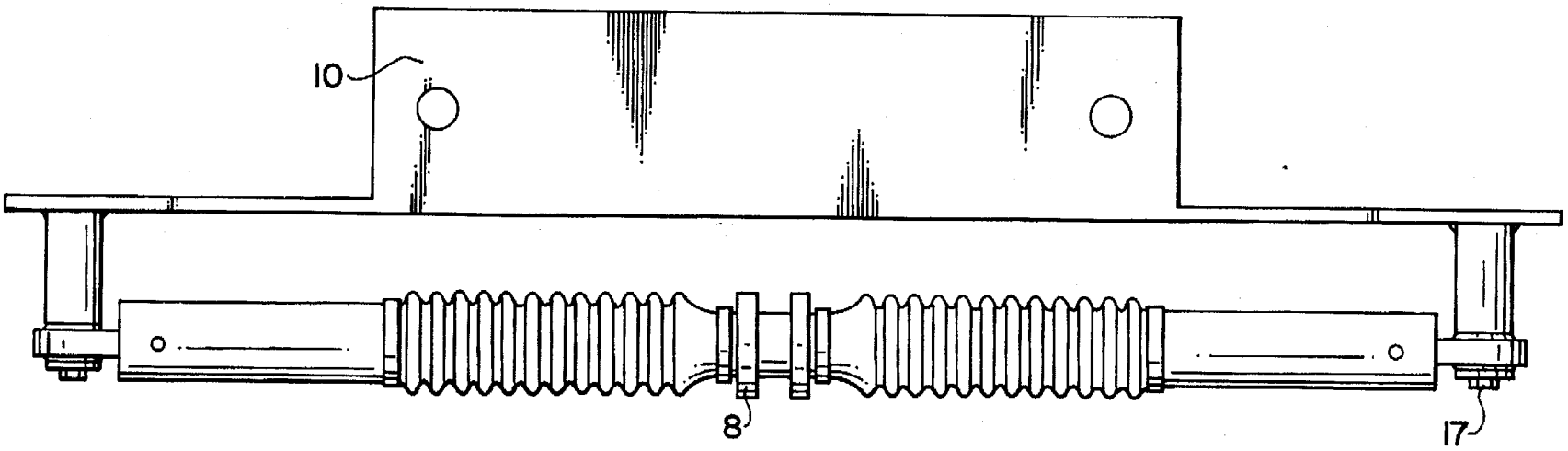
FIG. 5 is a top view on the illustration according to FIG. 4.

The mode of functioning of the hydraulic cylinder/piston units and their preferred configuration is explained in more detail in FIGS. 4 and 5. FIGS. 4 and 5 depict a hydraulic cylinder/piston unit 7 comprising a plunger 11. The plungers 11 plunge into the respective working volumes 13 of the hydraulic cylinder/piston units via sealings 12, medium each being pressed out of the respective working volume 13 upon displacement of the plunger 11 in one of the directions indicated by double arrow 14. The hydraulic connections run to the externally provided openings 15 in the respective working volume 13. The sliding block is again denoted by 8, effecting mechanical coupling. A rubber sleeve 16 is provided to protect the device.

In FIG. 5 the device according to FIG. 4 is visible in top view. As can also be taken from the illustration according to FIG. 4, equal cross sections are each effective on either side with such a configuration of the hydraulic cylinder/piston unit. The fixation of the cylinders of the hydraulic cylinder/piston units is realized on the angle plate 10 via bolts 17.

Figure 6:
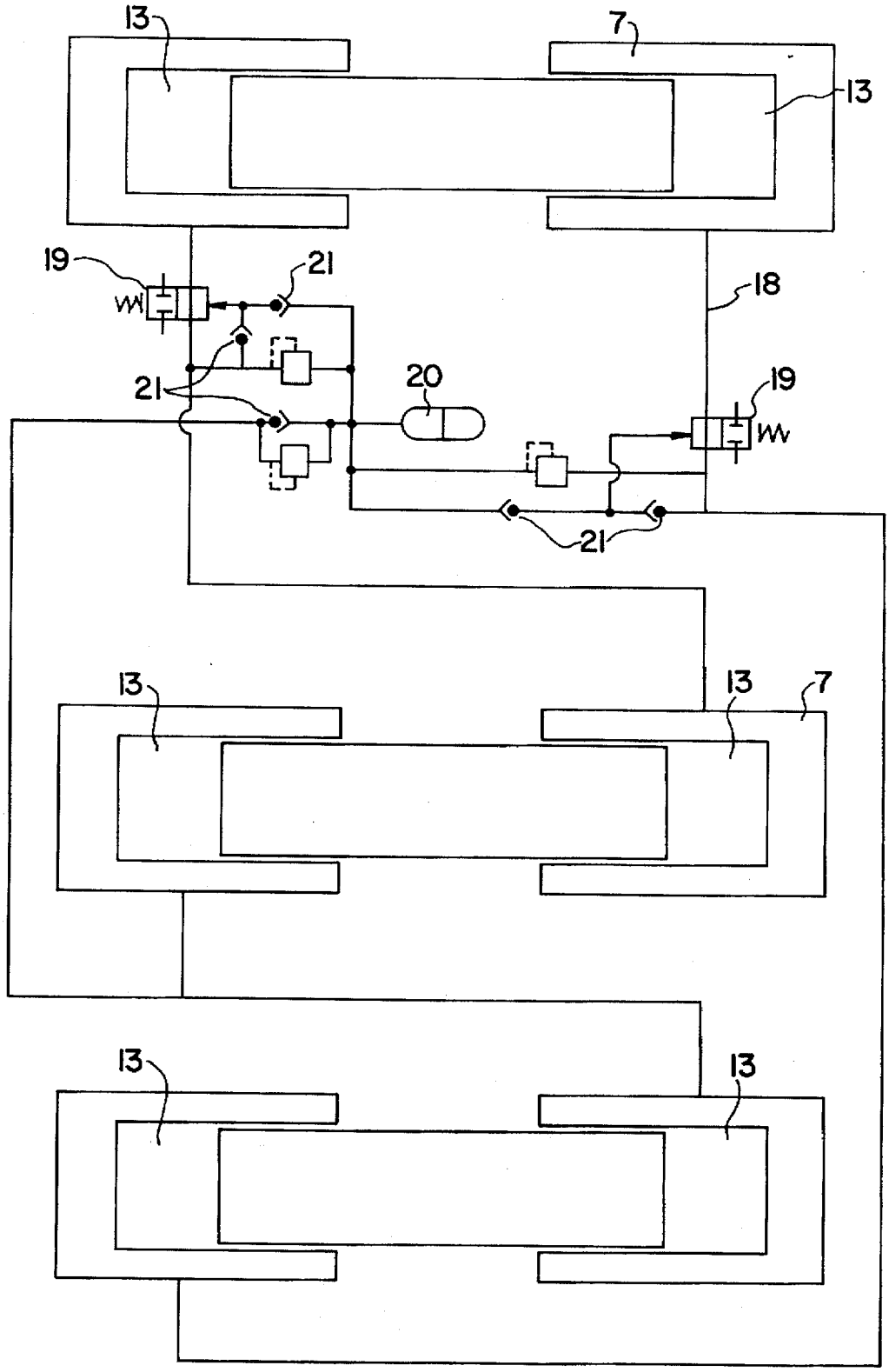
FIG. 6 is a schematic representation of the hydraulic connection of the individual cylinder/piston units.

As is apparent from FIG. 6, the working volumes 13 of the first hydraulic cylinder/piston unit 7 acting as a pumping element are connected with the respective working volumes 13 of neighboring hydraulic cylinder/piston units 7 via hydraulic ducts 18, the connection being realized in a manner that, upon displacement of the first hydraulic cylinder/piston unit, which acts as a pumping element, all the other hydraulic cylinder/piston units 7 will be coupled for unidirectional displacement. If hydraulic cylinder/piston units arranged in parallel or in series are to follow a course differing from that covered by the hydraulic cylinder/piston unit used as a pumping element, the cross section must be acted upon accordingly, to which end an appropriate sealing member may be arranged in the interior of the cylinders to reduce said cross section. The hydraulic ducts 18 contain a number of valves to keep the pressure constant under operating conditions and to be able to safely seize inadmissible situations. In detail, there is provided a spring-loaded valve 19 actuated by, the hydraulic pressure prevailing within the ducts 18. If the pressure within the hydraulic ducts 18 falls below a limit value, the force of the spring of the spring-loaded valve 19 will set the spring-loaded valve 19 into the closed position so as to avoid further displacement of the hydraulic cylinder/piston unit 7 acting as a pumping element. In that case, the switch actuator is blocked and an appropriate fault message is delivered.

Furthermore, a pressure reservoir 20 is provided, which is connected with the respective hydraulic ducts 18 via overflow valves or nonreturn valves 21. The overflow valves or nonreturn valves are switched in a manner that fluid will be pressed into the reservoir 20 at an increase in pressure due to thermal expansion and, vice versa, fluid will be pressed back from the hydraulic reservoir 20 into the ducts 18 at a slight decrease of the pressure. The spring-loaded safety valves 19 will enter into effect only upon leakage and a respective pressure decrease brought about in the reservoir 20.

Figure 7:
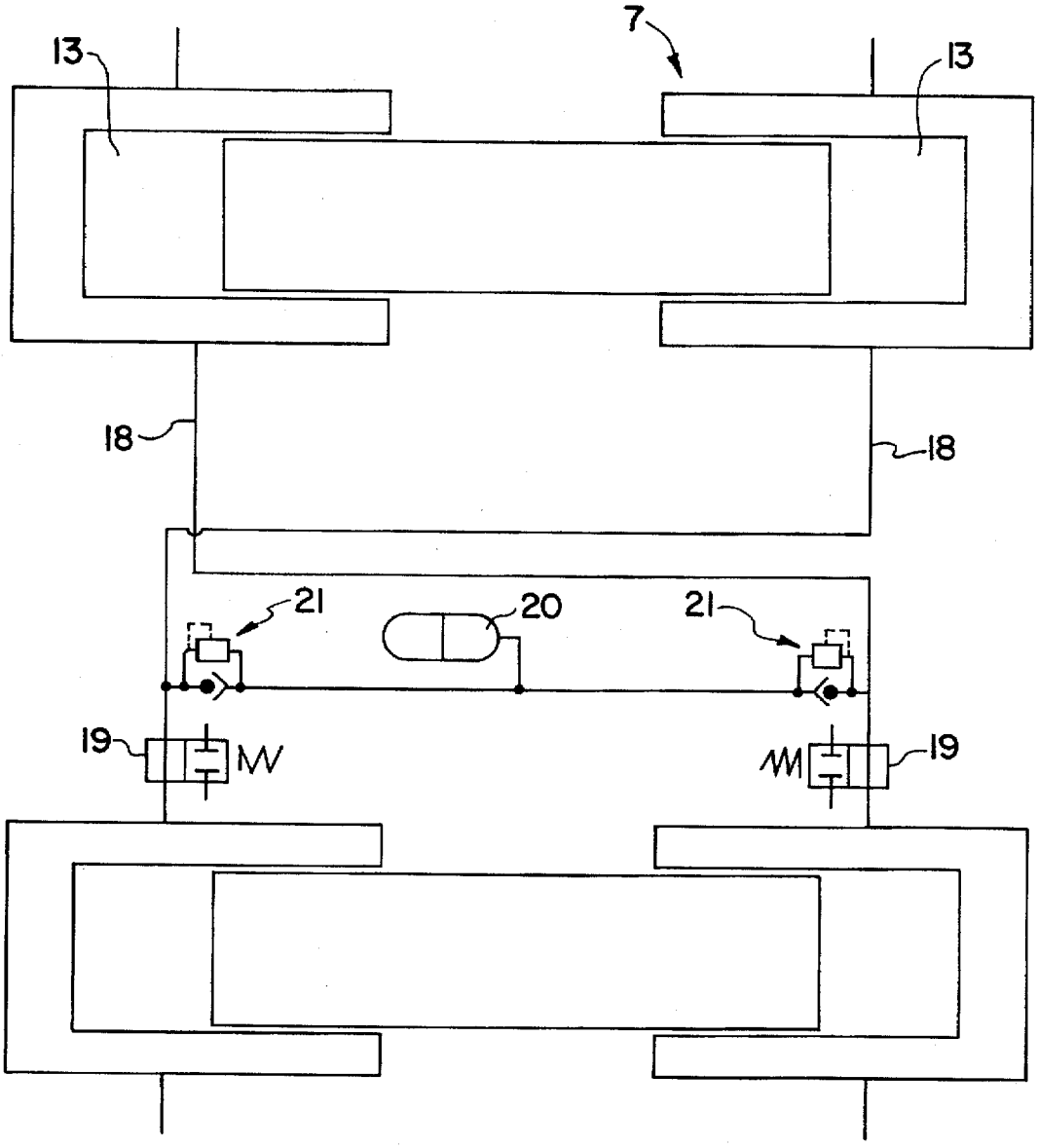
FIG. 7 is a modified configuration of the hydraulic connection.

FIG. 7 depicts a simplified configuration of the hydraulic rod assembly. The reference numerals from FIG. 6 have been retained in FIG. 7. As is apparent from the simplified configuration according to FIG. 7, a smaller number of valves will do with equal effects being achieved. Also in that case a pressure reservoir 20 is connected to the overall hydraulic circuit in order to balance out oil leakages, hydraulic liquid thus being returned into the reservoir 20 at a response of one of the overpressure valves 21. The biased valves or safety valves 19 are actuated by the receiver pressure from the piston reservoir. Overpressure may be caused, in particular, by too strong heating-up due to sun radiation. In the representation of FIG. 7, the piston volumes again are connected in series, the pumping element again being provided with biassed valves or safety valves 19. Both connection ducts again are separately secured by means of overpressure valves.

Figure 8:
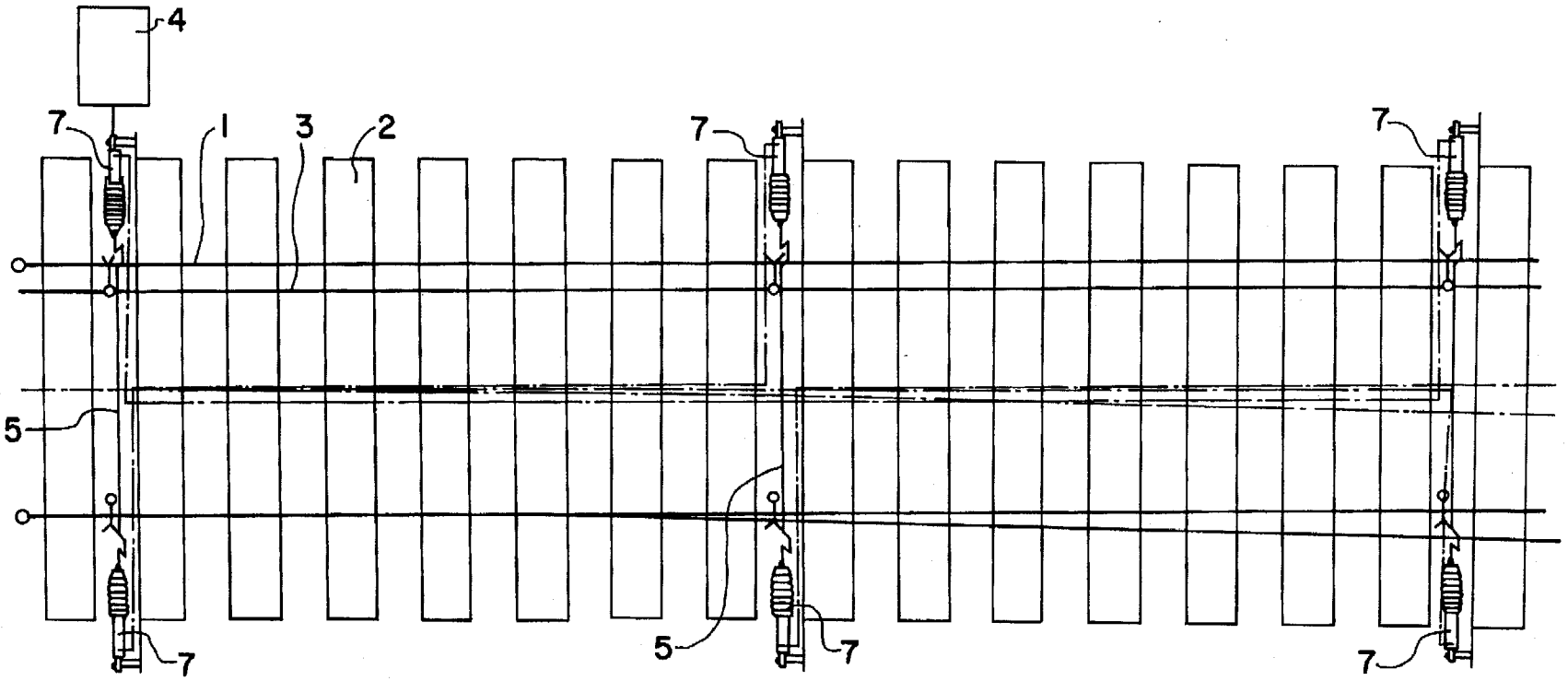
FIG. 8 depicts an alternative arrangement of hydraulic cylinder/piston units in the track extension and FIGS. 9, 10 and 11 represent further alternative embodiments of cylinder/piston units intended for the device according to the invention.

In the representation according to FIG. 8, modified hydraulic cylinder/piston units 7 are provided, each contacting the ends of the slide rods 5. In principle, the modified cylinder/piston units 7 fulfill the same purpose as the configuration according to FIG. 1, yet the functions of displacement to the left or to the right are separated from each other, no common plunger or piston being employed for both working volumes.

Figure 9:
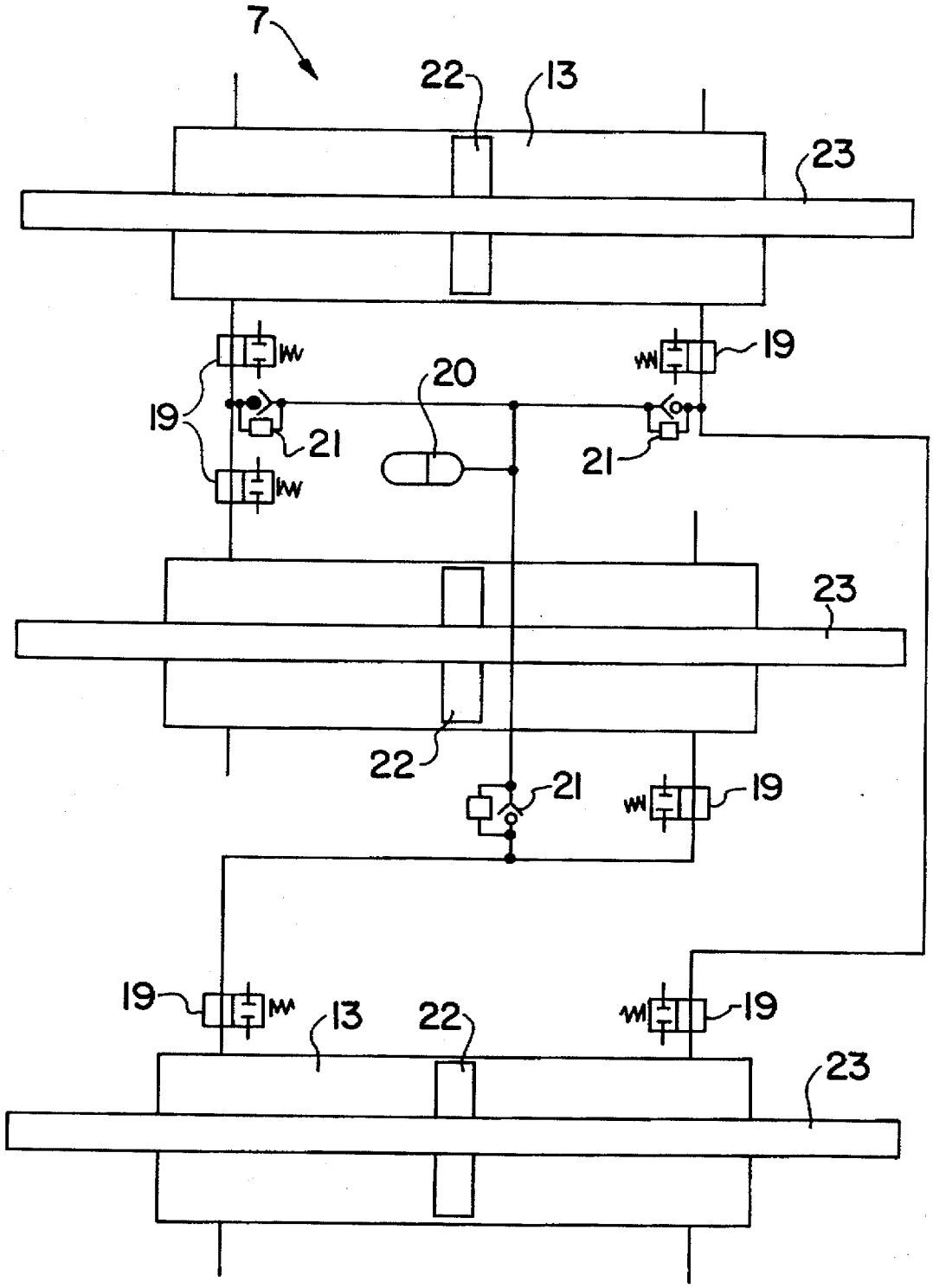

From FIG. 9 a modified design of the hydraulic cylinder/piston units is apparent. Also in this case, the configuration for the purpose of providing equal working surfaces with fluid is devised such that equal cross sections of a piston each become effective in the two working volumes 13. The piston 22 is connected with a piston rod 23, the annular surface each becoming effective or being actuated in the instant case. Moreover, the same components as in the configuration according to FIG. 6 or 7 have been employed, the same reference numerals having been applied again. Deviating from the configuration according to FIG. 6 or 7, a deadlock is caused immediately at a pressure decrease of any of the cylinder/piston units, all of the working volumes 13 being equipped with suitable safety valves.

Figure 10:
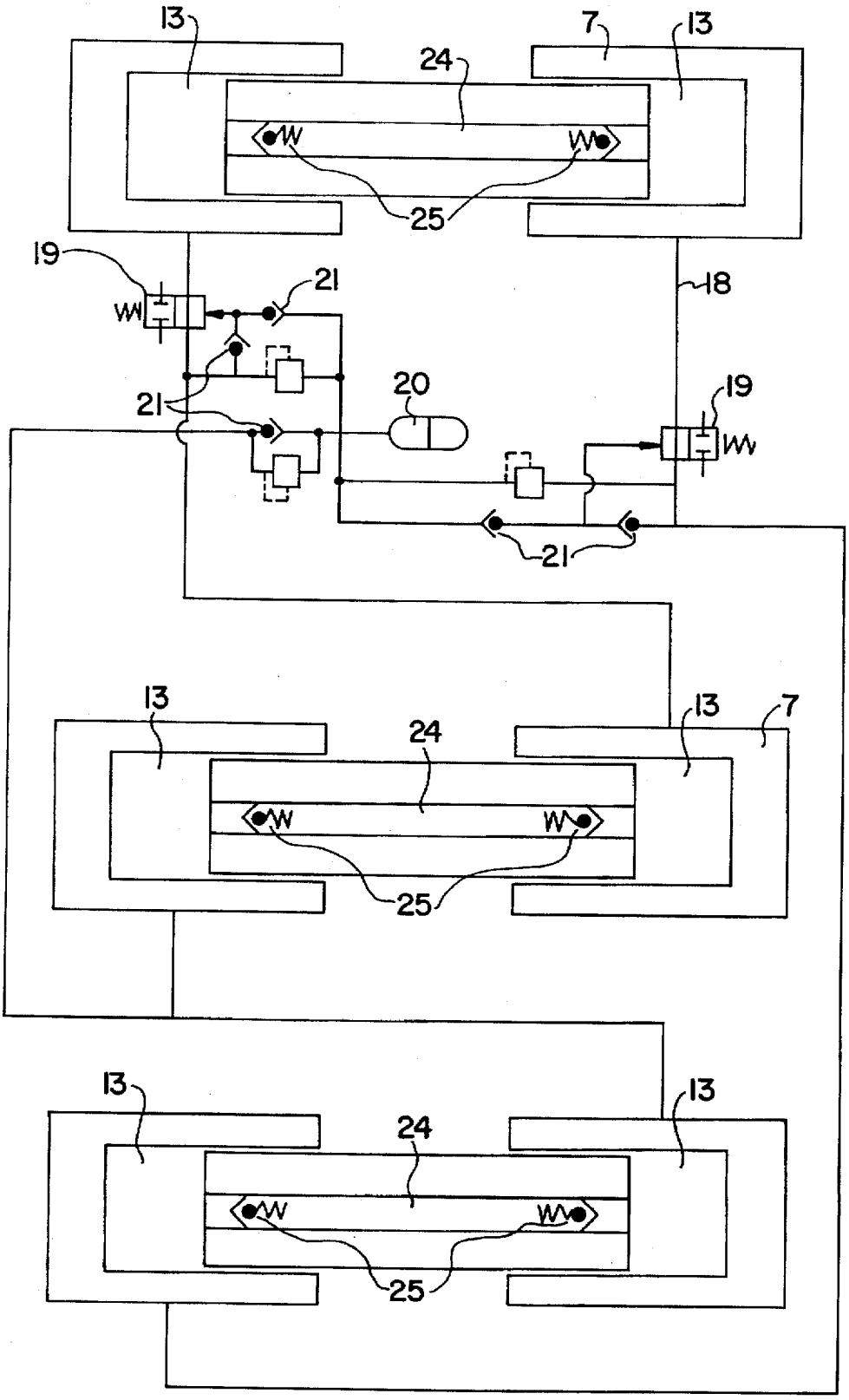
Figure 11:
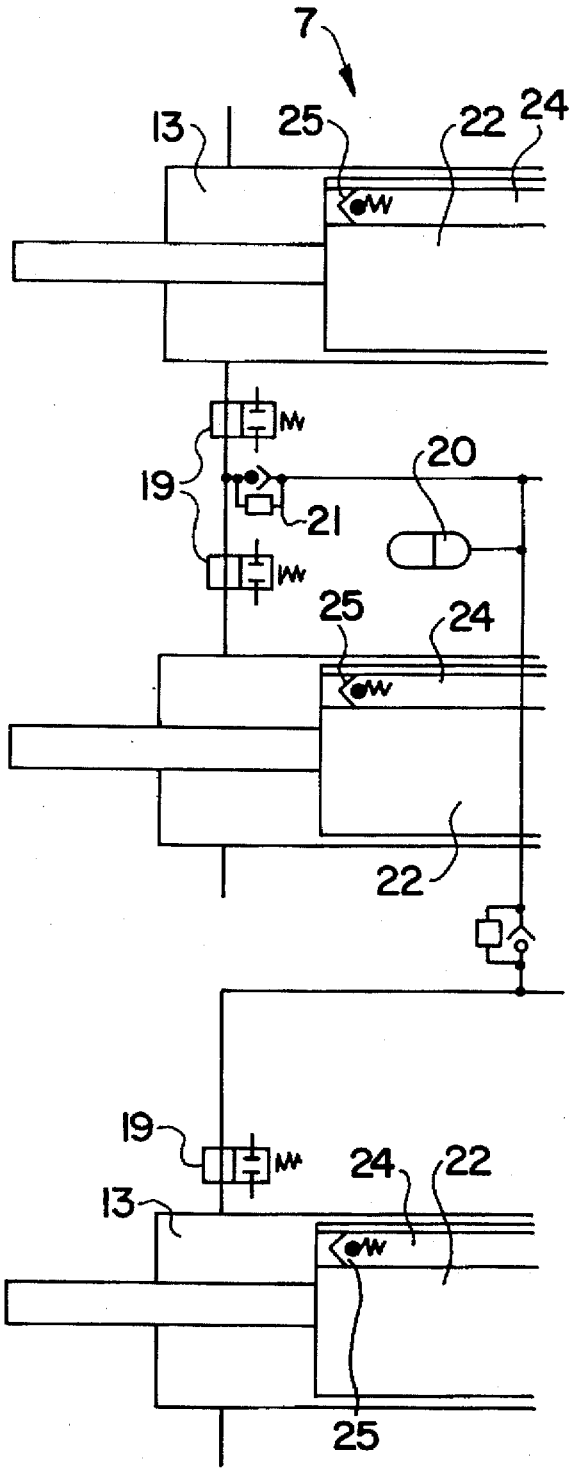

In FIGS. 10 and 11, the working volumes 13 of a cylinder/piston unit 7 are interconnected by a duct 24 constituted by a bore, in which push-open valves 25 are installed. These valves, if appropriately adjusted, effect the exact course-dependent displacement required, whereby the alternately possible cross sectional changes may be obviated.

The individual displacement paths of these locks roughly may be predetermined by defining the diameter ratios, precise detailed adjustment being feasible via the push-open valves by regulating the stroke of the plunger by adjustment of the cylinder bottom relative to the push-open valve. After each switching procedure, readjustment is effected by the reference circuit of the push-open valves. Any displacement of a piston due to leakages thus will be corrected by readjustment after completion of a switching procedure.

The use of such adjustable push-open valves ensures the hydraulic synchronism, which means that no displacement cylinder is able to run ahead and hence no tongue distortion can occur. Thus, the end positions of the tongue rail are reached in a concerted manner.

What is claimed is:

1. An arrangement for operating a rail switch having a mechanical switching device, said arrangement including a plurality of interlinked hydraulic switching devices separated in the longitudinal direction of the rails and each comprising a hydraulic cylinder/piston unit, at least one of said hydraulic switching devices being directly connected with the mechanical switching device, said units each having cylindrical volumes defined by the cylinder and the piston of the respective unit, said volumes of respective units being hydraulically interconnected whereby when a piston of one of said units is displaced relative to its cylinder in response to displacement of the mechanical switching device, thereby pumping fluid from one of the unit's cylindrical volumes in accordance with the piston's displacement, the pistons of the remaining units are displaced in the same direction.

2. A rail switch operating arrangement as set forth in claim 1, wherein each of the hydraulic cylinder/piston units has two cylindrical volumes located adjacent opposite surfaces of the piston, said surfaces having substantially identical areas.

3. A rail switch operating arrangement as set forth in claim 2, further comprising a sliding block operatively joined to the mechanical switching device and to the piston of each hydraulic switching device which is connected with the mechanical switching device.

4. A rail switch operating arrangement as set forth in claim 2, wherein the piston of at least one of the hydraulic switching devices is rigidly connected with a continuous piston rod passing through seals at opposite ends of the cylinder, and wherein one of piston rod or its associated cylinder is fixed when the said one cylinder and its piston are displaced relative to one another.

5. A rail switch operating arrangement as set forth in any one of claims 1 to 4, wherein the cylindrical volumes of the hydraulic cylinder/piston units are connected with a pressure reservoir via overpressure valves.

6. A rail switch operating arrangement as set forth in claim 5, wherein said overpressure valves are nonreturn valves which may be triggered.

7. A rail switch operating arrangement as set forth in any one of claims 1 to 4, wherein the hydraulic interconnection between cylindrical volumes of respective units includes at least one pressure-controlled directional control valve which closes when the pressure of hydraulic fluid pumped from one of the cylindrical volumes falls below a predetermined value.

8. A rail switch operating arrangement as set forth in claim 2, herein said opposite surfaces of the piston are joined by a bore passing through the piston, said arrangement further comprising at least one push-open valve located within the bore.

9. A rail switch operating arrangement as set forth in claim 5, wherein the hydraulic interconnection between cylindrical volumes of respective units further includes at least one pressure-controlled directional control valve which closes when the pressure of hydraulic fluid pumped from one of the cylindrical volumes falls below a predetermined value.

* * * * *